US007488065B2

(12) United States Patent
Yokoyama

(10) Patent No.: US 7,488,065 B2
(45) Date of Patent: Feb. 10, 2009

(54) INK JET PRINTER

(75) Inventor: Takeshi Yokoyama, Hachioji (JP)

(73) Assignee: Konica Minolta Holdings, Inc. (JP)

( * ) Notice: Subject to any disclaimer, the term of this patent is extended or adjusted under 35 U.S.C. 154(b) by 174 days.

(21) Appl. No.: 10/731,287

(22) Filed: Dec. 9, 2003

(65) Prior Publication Data

US 2004/0114017 A1 Jun. 17, 2004

(30) Foreign Application Priority Data

Dec. 12, 2002 (JP) ..... 2002-360920
Nov. 19, 2003 (JP) ..... 2003-389235

(51) Int. Cl.
*B41J 2/01* (2006.01)

(52) U.S. Cl. ..... 347/102; 347/101

(58) Field of Classification Search ..... 347/102, 347/213, 224, 101
See application file for complete search history.

(56) References Cited

U.S. PATENT DOCUMENTS 4,991,506 A 2/1991 Rodi
5,666,140 A * 9/1997 Mitani et al. ..... 347/12
6,078,713 A 6/2000 Tausch et al.
6,145,979 A * 11/2000 Caiger et al. ..... 347/102
6,350,071 B1 2/2002 Conwell et al.
6,523,948 B2 * 2/2003 Matsumoto et al. ..... 347/102
6,561,640 B1 * 5/2003 Young ..... 347/102
6,598,531 B2 * 7/2003 Nedblake et al. ..... 101/490
6,846,074 B2 * 1/2005 Hirai ..... 347/102
2001/0038408 A1 11/2001 Codos et al.
2002/0149660 A1 10/2002 Cleary et al.

FOREIGN PATENT DOCUMENTS

EP 0 378 826 A2 12/1989
WO WO 01/11426 A1 2/2001

OTHER PUBLICATIONS

European Search Report for Application No. 03257731.4-2304/ dated Feb. 2, 2005.
English Abstract for Japanese Patent No. 60132767 dated Jul. 15, 1985.
European Search Report for Application No. 03257731.4 dated Apr. 13, 2005.

* cited by examiner

*Primary Examiner*—Manish S Shah
(74) *Attorney, Agent, or Firm*—Cantor Colburn LLP

(57) ABSTRACT

An ink jet printer has a line print type recording heads, respectively extending in a width direction of a recording medium, for jetting ink to the recording medium, and ultraviolet ray irradiating devices, having ultraviolet ray sources, for irradiating the ink arriving at the recording medium with ultraviolet rays to cure the ink. The ultraviolet ray irradiating devices are arranged on a downstream side of the recording heads in a feeding direction of the recording medium. A quantity of the ultraviolet rays emitted from the ultraviolet ray sources of the ultraviolet ray irradiating device, which is arranged on the most downstream side in the feeding direction of the recording medium, is set to be larger than that of the ultraviolet rays emitted from the ultraviolet ray sources of each of the other ultraviolet ray irradiating devices.

20 Claims, 5 Drawing Sheets

INK JET PRINTER

BACKGROUND OF THE INVENTION

1. Field of the Invention

The present invention relates to an ink jet printer, and particularly to an ink jet printer in which ultraviolet ray curable ink is used.

2. Description of Related Art

An ink jet printer is used to record an image on a recording medium by jetting ink from nozzles arranged on one surface of a recording head and making the ink collide with the recording medium. In this ink jet printer, an ink jet recording method of using ultraviolet ray curable ink has been known as a method of forming an image even on a recording medium having the property of a low ink absorption such as a resin film or the like (for example, disclosed in Published Japanese Patent Publication (Tokkaisyou) 60-132767). In the ink jet printer according to the ink jet recording method, ultraviolet curable ink, which includes a photochemical initiator having a predetermined sensitivity to ultraviolet rays, is used, the ink arriving at the recording medium is irradiated with the ultraviolet rays, and the ink is cured and fixed to the recording medium. In case of the ink jet printer using the ultraviolet curable ink, in the period of time from the arriving of the ink at the recording medium to the curing and fixing of the ink through the irradiation with the ultraviolet rays, a change in the image quality is caused by the enlarging of the diameter of dots of the ink arriving at the recording medium, the blurring of the recording medium with the ink between the dots and the permeation of the ink to the recording medium. Therefore, to form an image of the high quality by preventing the enlarging of the diameter of dots of the ink and the blurring of the recording medium with the ink, it is preferred that the period of time from the jetting of the ultraviolet ray curable ink to the irradiation of the ink with the ultraviolet rays is set to be as short as possible to cure and fix the ink in a short time.

Therefore, as shown in FIGS. 4 and 5, in the earlier developed ink jet printer, each of a plurality of recording heads having nozzles, from which the ultraviolet ray curable ink is jetted onto the recording medium, extends in the width direction of the recording medium, and the recording heads are arranged at predetermined intervals so as to make the longitudinal directions of the recording heads be parallel to one another, and a plurality of ultraviolet ray irradiating devices close to the recording heads respectively and having the same width and size as one another are arranged on the downstream side of the recording heads in the feeding direction of the recording medium respectively.

As described above, in the earlier development, each ultraviolet ray irradiating device emits a quantity of ultraviolet rays sufficient to almost perfectly cure the ink jetted onto the recording medium.

However, to obtain the quantity of ultraviolet rays required to almost perfectly cure the ink, large-sized ultraviolet ray irradiating devices are required, and the devices become large in size and complicated in structure. On the other hand, the change in the image quality caused by the enlarging of the diameter of dots of the ink, the blurring of the recording medium with the ink and the like occurs in dependent on the quantity of the ultraviolet rays, the irradiation timing of the ultraviolet rays, the wavelength of the ultraviolet rays, the intensity of the ultraviolet rays and the like. To form the image of the high quality while preventing the change in the image quality, the quantity in the ultraviolet rays required to cure the surfaces of the dots of the ink is sufficient when the ink is irradiated with the ultraviolet rays just after the jetting of the ink, and the quantity of the ultraviolet rays for curing the ink almost perfectly is not required. Therefore, the quantity of the ultraviolet rays is excessive in the earlier development to irradiate the ink with the ultraviolet rays. As a result, problems are arisen that the size of the device is enlarged, the cost of manufacturing the device is heightened, and electric power consumed to irradiate the ink with the ultraviolet rays is enlarged.

Further, generally, the ultraviolet ray irradiating devices and the recording heads are alternately arranged to place each ultraviolet ray irradiating device between two recording heads. Therefore, when the large-sized ultraviolet ray irradiating devices are used, the interval of two recording heads adjacent to each other is enlarged. As a result, because the irradiation timing of the ultraviolet rays is delayed, another problem is arisen that the enlarging of the diameter of dots of the ink, the blurring of the recording medium with the ink and the like easily occur.

SUMMARY OF THE INVENTION

In order to solve the above problem, an object of the present invention is to provide an ink jet printer, which is simplified and miniaturized by reducing a quantity of light emitted from light sources while maintaining an image quality and in which the consumed electric power and the cost of manufacturing the printer are reduced.

In order to accomplish the above-mentioned object, in accordance with the first aspect of the present invention, an ink jet printer comprises:

a line print type recording heads, respectively extending in a width direction of a recording medium, for jetting ink, which is to be cured by being irradiated with an ultraviolet ray, to the recording medium; and a plurality of ultraviolet ray irradiating devices, having a plurality of ultraviolet ray sources, for irradiating the ink jetted by the recording heads with a plurality of ultraviolet rays, after arriving of the ink at the recording medium, to cure the ink, wherein the ultraviolet ray irradiating devices are arranged on a downstream side of the recording heads in a feeding direction of the recording medium, and wherein a quantity of the ultraviolet rays emitted from the ultraviolet ray source or the ultraviolet ray sources of the ultraviolet ray irradiating device, which is arranged on the most downstream side in the feeding direction of the recording medium, is set to be larger than that of the ultraviolet rays emitted from the ultraviolet ray source or the ultraviolet ray sources of the other ultraviolet ray irradiating device or each of the other ultraviolet ray irradiating devices.

In the ink jet printer according to the first aspect of the present invention, each of the ultraviolet ray irradiating devices except the ultraviolet ray irradiating device arranged on the most downstream side in the feeding direction of the recording medium emits a quantity of ultraviolet rays sufficient to cure only the surface of the ink, and only the ultraviolet ray irradiating device arranged on the most downstream side in the feeding direction of the recording medium emits a quantity of ultraviolet rays sufficient to almost perfectly cure the ink.

Accordingly, when the ink jet printer is of a line print type, the ultraviolet ray irradiating devices arranged adjacent to the recording heads respectively and an image recording section of the ultraviolet ray irradiating devices can be miniaturized, and the consumed electric power can be reduced.

In detail, to prevent the change in the image quality caused by the enlarging of the diameter of dots of the ink arriving at the recording medium, the blurring of the recording medium with the ink and the like, it is sufficient to irradiate the ink with a quantity of ultraviolet rays sufficient to cure only the surface of the ink just after the arriving of the ink at the recording medium. In this invention, just after the arriving of the ink at the recording medium, the ink is irradiated with a quantity of ultraviolet rays sufficient to cure only the surface of the ink. Thereafter, the ultraviolet ray irradiating devices irradiate the ink one after another with ultraviolet rays in the order from the device of the upstream side to the device of the downstream side in the feeding direction of the recording medium to gradually cure the ink, and the ultraviolet ray irradiating device arranged on the most downstream side in the feeding direction of the recording medium finally irradiates the ink with a quantity of ultraviolet rays required to almost perfectly cure and fix the ink to the recording medium. Accordingly, the ink jet printer can be efficiently miniaturized while maintaining the high image quality, and the consumed electric power can be reduced.

Further, in this invention, because each ultraviolet ray irradiating device arranged between two recording heads can be miniaturized, the interval of the two recording heads can be narrowed. Accordingly, because the irradiation timing of the ultraviolet rays becomes earlier, the enlarging of the diameter of dots of the ink, the blurring of the recording medium with the ink and the like can be easily prevented, and the image quality can be improved.

Preferably, the number of ultraviolet ray sources of the ultraviolet ray irradiating device arranged on the most downstream side in the feeding direction of the recording medium is larger than that of the other ultraviolet ray irradiating device or each of the other ultraviolet ray irradiating devices.

Preferably, the ultraviolet rays emitted from the ultraviolet ray source or the ultraviolet ray sources of the ultraviolet ray irradiating device, which is arranged on the most downstream side in the feeding direction of the recording medium, has a longer wavelength or more longer wavelength components than a wavelength or longer wavelength components of the ultraviolet rays emitted from the ultraviolet ray source or the ultraviolet ray sources of the other ultraviolet ray irradiating device or each of the other ultraviolet ray irradiating devices.

Preferably, each ultraviolet ray irradiating device is arranged on the downstream side of the corresponding recording head in the feeding direction of the recording medium.

Preferably, each of the ultraviolet ray sources is one of a high pressure mercury lamp, a low pressure mercury lamp, a metal halide lamp, a cold cathode tube, a semiconductor laser and a light emitting diode.

In this invention, even though each ultraviolet ray source is the high pressure mercury lamp, the low pressure mercury lamp, the metal halide lamp, the cold cathode tube, the semiconductor laser or the light emitting diode, the ultraviolet ray irradiating devices can be miniaturized by reducing the quantity of the ultraviolet rays emitted from the ultraviolet ray sources, the consumed electric power can be reduced, and the cost of manufacturing the ink jet printer can be reduced.

Preferably, each of the ultraviolet ray sources is obtained by combining two of a high pressure mercury lamp, a low pressure mercury lamp, a metal halide lamp, a cold cathode tube, a semiconductor laser and a light emitting diode.

Preferably, the ink is a cationic polymerization type ink.

In this invention, the image can be recorded on various recording mediums by using the property of the ink to be cured by the irradiation with the ultraviolet rays. Even though the ink is used, the quantity of the ultraviolet rays required to cure the ink can be obtained by repeatedly irradiating the ink with a small quantity of ultraviolet rays. Accordingly, the miniaturization of the ink jet printer and the reduction of the consumed electric power can be obtained while maintaining the high image quality.

In accordance with the second aspect of the present invention, an ink jet printer comprises:

a line print type recording heads, respectively extending in a width direction of a recording medium, for jetting ink, which is to be cured by being irradiated with an ultraviolet ray, to the recording medium; and a plurality of ultraviolet ray irradiating devices, having a plurality of ultraviolet ray sources, for irradiating the ink jetted by the recording heads with a plurality of ultraviolet rays, after arriving of the ink at the recording medium, to cure the ink, wherein the ultraviolet ray irradiating devices are arranged on a downstream side of the recording heads in a feeding direction of the recording medium, and wherein intensity of the ultraviolet rays emitted from the ultraviolet ray source or the ultraviolet ray sources of the ultraviolet ray irradiating device, which is arranged on the most downstream side in the feeding direction of the recording medium, is set to be higher than that of the ultraviolet rays emitted from the ultraviolet ray source or the ultraviolet ray sources of the other ultraviolet ray irradiating device or each of the other ultraviolet ray irradiating devices.

Preferably, the number of ultraviolet ray sources of the ultraviolet ray irradiating device arranged on the most downstream side in the feeding direction of the recording medium is larger than that of the other ultraviolet ray irradiating device or each of the other ultraviolet ray irradiating devices.

Preferably, the ultraviolet rays emitted from the ultraviolet ray source or the ultraviolet ray sources of the ultraviolet ray irradiating device, which is arranged on the most downstream side in the feeding direction of the recording medium, has a longer wavelength or more longer wavelength components than a wavelength or longer wavelength components of the ultraviolet rays emitted from the ultraviolet ray source or the ultraviolet ray sources of the other ultraviolet ray irradiating device or each of the other ultraviolet ray irradiating devices.

Preferably, each ultraviolet ray irradiating device is arranged on the downstream side of the corresponding recording head in the feeding direction of the recording medium.

Preferably, each of the ultraviolet ray sources is one of a high pressure mercury lamp, a low pressure mercury lamp, a metal halide lamp, a cold cathode tube, a semiconductor laser and a light emitting diode.

Preferably, each of the ultraviolet ray sources is obtained by combining two of a high pressure mercury lamp, a low pressure mercury lamp, a metal halide lamp, a cold cathode tube, a semiconductor laser and a light emitting diode.

Preferably, the ink is a cationic polymerization type ink.

In accordance with the third aspect of the present invention, an ink jet printer comprises:

a line print type recording heads, respectively extending in a width direction of a recording medium, for jetting ink, which is to be cured by being irradiated with an ultraviolet ray, to the recording medium; and a plurality of ultraviolet ray irradiating devices, having a plurality of ultraviolet ray sources, for irradiating the ink jetted by the recording heads with a plurality of ultraviolet rays, after arriving of the ink at the recording medium, to cure the ink, wherein the ultraviolet rays emitted from the ultraviolet ray source or the ultraviolet ray sources of the ultraviolet ray irradiating device, which is arranged on the most downstream side in the feeding direction of the recording medium, has a longer wavelength or more longer wavelength components than a wavelength or longer wavelength components of the ultraviolet rays emitted from the ultraviolet ray source or the ultraviolet ray sources of the other ultraviolet ray irradiating device or each of the other ultraviolet ray irradiating devices.

Preferably, the number of ultraviolet ray sources of the ultraviolet ray irradiating device arranged on the most downstream side in the feeding direction of the recording medium is larger than that of the other ultraviolet ray irradiating device or each of the other ultraviolet ray irradiating devices.

Preferably, the ultraviolet rays emitted from the ultraviolet ray source or the ultraviolet ray sources of the ultraviolet ray irradiating device, which is arranged on the most downstream side in the feeding direction of the recording medium, has a longer wavelength or more longer wavelength components than a wavelength or longer wavelength components of the ultraviolet rays emitted from the ultraviolet ray source or the ultraviolet ray sources of the other ultraviolet ray irradiating device or each of the other ultraviolet ray irradiating devices.

Preferably, each ultraviolet ray irradiating device is arranged on the downstream side of the corresponding recording head in the feeding direction of the recording medium.

Preferably, each of the ultraviolet ray sources is one of a high pressure mercury lamp, a low pressure mercury lamp, a metal halide lamp, a cold cathode tube, a semiconductor laser and a light emitting diode.

Preferably, each of the ultraviolet ray sources is obtained by combining two of a high pressure mercury lamp, a low pressure mercury lamp, a metal halide lamp, a cold cathode tube, a semiconductor laser and a light emitting diode.

Preferably, the ink is a cationic polymerization type ink.

BRIEF DESCRIPTION OF THE DRAWINGS

The present invention will become more fully understood from the detailed description given hereinbelow and the accompanying drawing which are given by way of illustration only, and thus are not intended as a definition of the limits of the present invention, and wherein.

PREFERRED EMBODIMENTS OF THE INVENTION

Figure 2A:
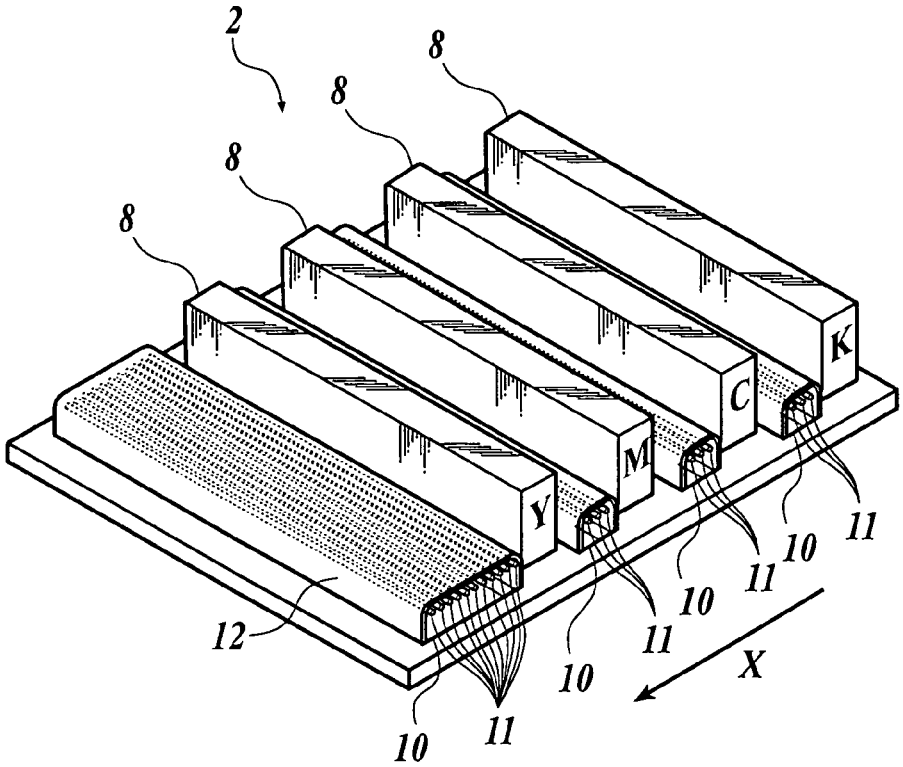
FIG. 2A is a perspective side view schematically showing an image recording section of the ink jet printer according to the present invention.
Figure 2B:
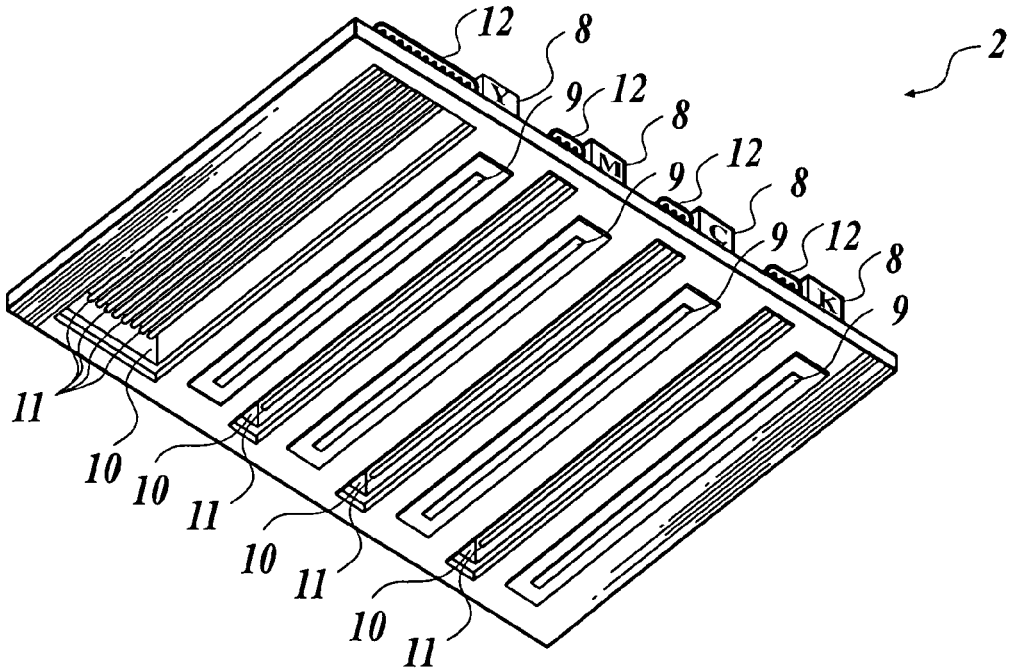
FIG. 2B is a perspective side view schematically showing the image recording section of FIG. 2A seen from its back side.
Figure 3:
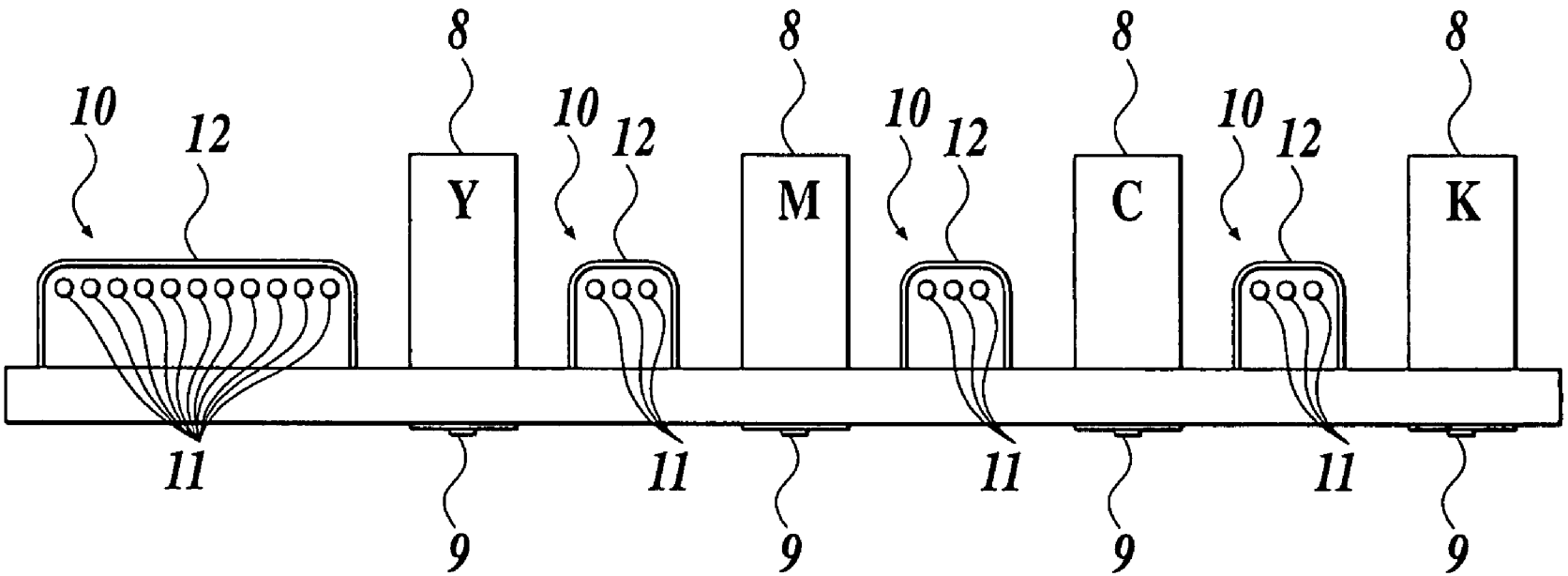
FIG. 3 is a perspective side view schematically showing the image recording section seen from its side in the ink jet printer according to the present invention.
Figure 4A:
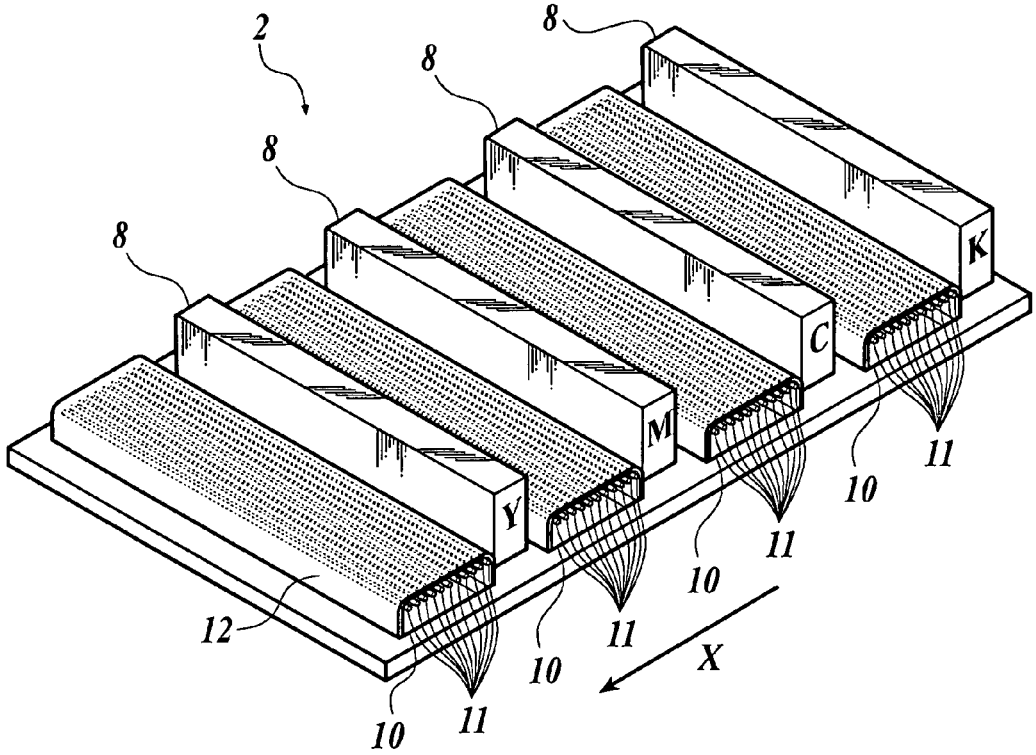
FIG. 4A is a perspective side view schematically showing an image recording section of an earlier developed ink jet printer.
Figure 4B:
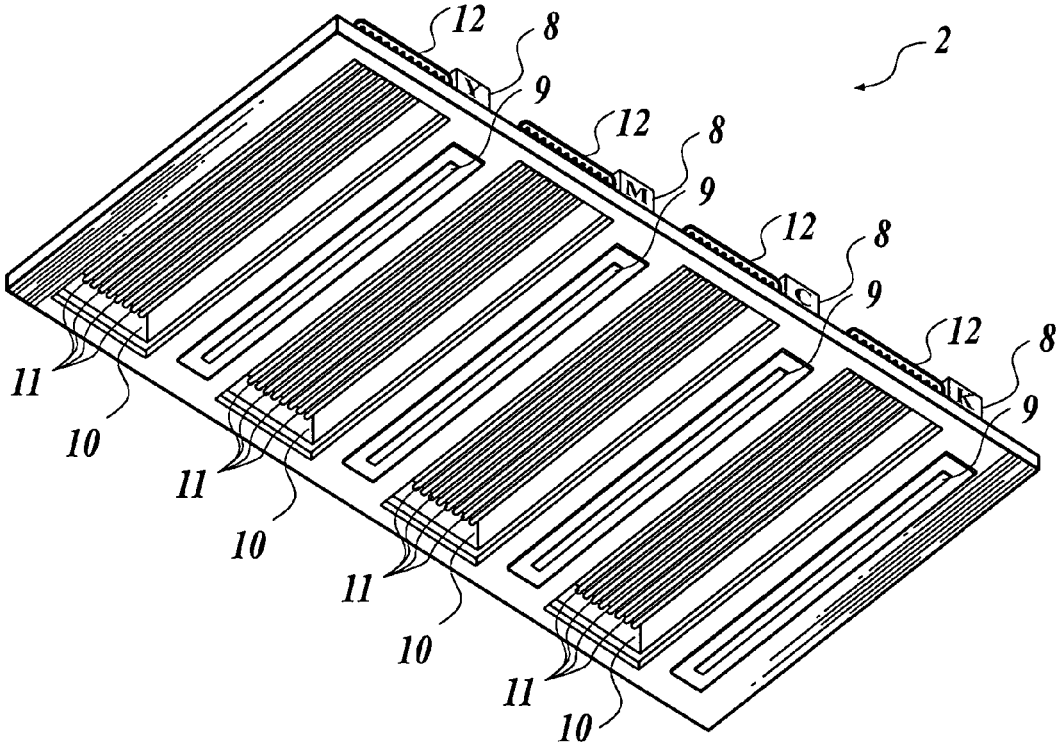
FIG. 4B is a perspective side view schematically showing the image recording section of FIG. 4A seen from its back side.
Figure 5:
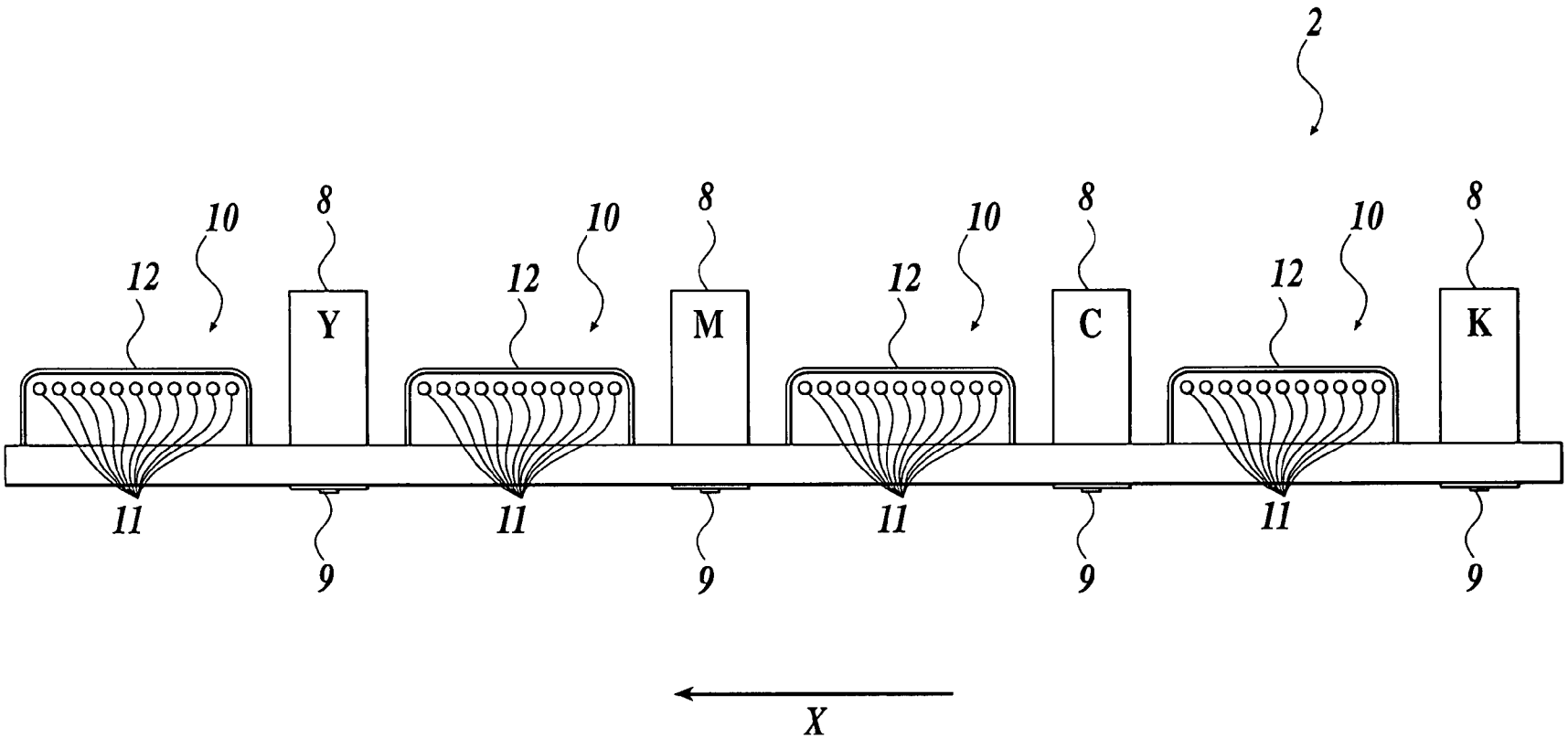
FIG. 5 is a perspective side view schematically showing the image recording section of the earlier developed ink jet printer seen from its side.

Hereinafter, the first embodiment of the present invention will be explained with reference to FIGS. 1 to 3.

Figure 1:
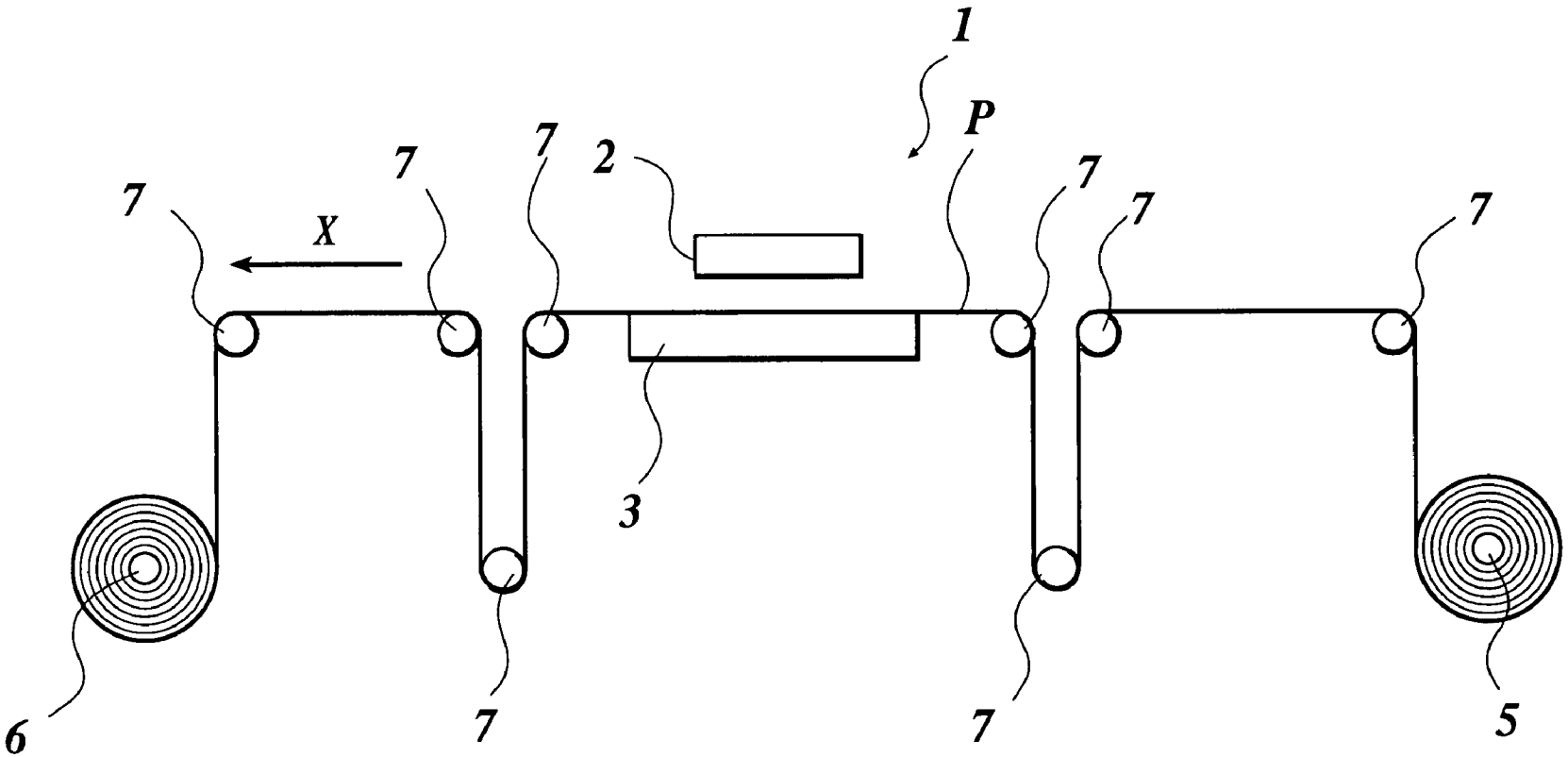
FIG. 1 is a side view schematically showing the structure of an ink jet printer according to the present invention.

As shown in FIG. 1, in this embodiment, an ink jet printer 1 is of a line print type. As shown in FIGS. 2 and 3, various types ink of yellow (Y), magenta (M), cyan (C) and black (Bk) are jetted from a plurality of recording heads 8 respectively, and the recording heads 8 are arranged on an image recording section 2. The image recording section 2 is formed so as to have a width larger than that of a recording medium P and extends in a feeding direction X of the recording medium P. Each recording head 8 has an outline formed in a rectangular parallelepiped and extends in the width direction of the recording medium P. The recording heads 8 are arranged at predetermined intervals so as to make the longitudinal directions of the recording heads 8 be parallel to one another. A plurality of nozzles 9 jetting ultraviolet curable ink toward the recording medium P are formed on a surface of each recording head 8 opposite to the recording medium P in a line parallel to the longitudinal direction of the recording head 8.

On the downstream side of each recording head 8 in the feeding direction X of the recording medium P, an ultraviolet ray irradiating device 10 having a length longer than that of the recording head 8 in the longitudinal direction of the recording head 8 is arranged close to the recording head 8. The ultraviolet ray irradiating device 10 has a cover member 12 having an opening on its one side and formed in a box shape, and the cover member 12 is arranged so as to set the opening of the cover member 12 be opposite to a recording surface of the recording medium P. A plurality of rod-shaped ultraviolet ray sources 11 emitting ultraviolet rays to cure and fix the ink arriving at the recording medium P are arranged under the upper surface of the cover member 12 formed in almost parallel to the recording surface of the recording medium P, and the longitudinal directions of the ultraviolet ray sources 11 are parallel to one another. Each ultraviolet ray source 11 may be obtained by using a light source selected from a high pressure mercury lamp, a low pressure mercury lamp, a metal halide lamp, a semiconductor laser, a cold cathode tube, a light emitting diode (LED) and the like.

Further, a plurality of types of ultraviolet ray sources 11 may be combined and arranged in each ultraviolet ray irradiating device 10. In this case, the wavelengths of the ultraviolet rays respectively emitted from the types of ultraviolet ray sources 11 differ from each other. The ink has the following property. When the ink is irradiated with the ultraviolet rays of a shorter wavelength, only the surface of the ink is cured. When the ink is irradiated with the ultraviolet rays of a longer wavelength, the ultraviolet rays reach the inside of the ink, and the ink can be almost perfectly cured. Therefore, as an example, a plurality of metal halide lamps, which emit the ultraviolet rays including many longer wavelength components, are used as the ultraviolet ray sources 11 of the ultraviolet ray irradiating device 10 arranged on the most downstream side in the feeding direction X of the recording medium P, and a plurality of LEDs are used as the ultraviolet ray sources 11 of the other ultraviolet ray irradiating devices 10. In this case, the ink can be reliably and almost perfectly cured by the ultraviolet ray irradiating device 10 arranged on the most downstream side.

Each of the ultraviolet ray irradiating devices 10 arranged adjacent to the recording heads 8 corresponding to yellow (Y), magenta (M), cyan (C) and black (Bk) is provided with the ultraviolet ray sources 11 which emit a quantity of ultraviolet rays sufficient to cure only the surface of the ink. As shown in FIGS. 2A and 2B, the ultraviolet ray irradiating device 10 arranged on the most downstream in the feeding direction X of the recording medium P and adjacent to the recording head 8 of yellow (Y) has a width in the feeding direction X of the recording medium P larger than those of the other ultraviolet ray irradiating devices 10 and is provided with the ultraviolet ray sources 11, of which the number is larger than that in each of the other ultraviolet ray irradiating devices 10 to emit ultraviolet rays having a quantity sufficient to reach the inside of the ultraviolet ray curable ink and to almost perfectly cure the ink.

The quantity of the ultraviolet rays denotes the energy of the ultraviolet rays and is determined as a product of the intensity of the ultraviolet rays and the irradiation time of the ultraviolet rays. Therefore, for example, even though each ultraviolet ray source 11 emits the same intensity of ultraviolet rays as that emitted from each of the other ultraviolet ray sources 11 of all the ultraviolet ray irradiating devices 10, when the irradiation time of the ultraviolet rays for the ink is lengthened by increasing the number of ultraviolet ray sources 11 of the ultraviolet ray irradiating device 10 arranged on the most downstream side in the feeding direction X of the recording medium P, the quantity of the ultraviolet rays emitted from the ultraviolet ray irradiating device 10 of the most downstream side in the feeding direction X of the recording medium P can be set to be larger than that emitted from each of the other ultraviolet ray irradiating devices 10.

Further, as shown in FIG. 1, a platen 3 is arranged under the image recording section 2 so as to support a non-recording surface of the recording medium P, and a main winding roller 5, on which the long recording medium P having a prescribed width is wound, is rotatably arranged on the upstream side of the platen 3 in the feeding direction X of the recording medium P. On the downstream side of the platen 3 in the feeding direction X, a winding roller 6, on which the recording medium P fed from the main winding roller 5 is wound, is arranged so as to be able to be rotationally driven by a driving source (not shown) such as a motor or the like. The driving source feeds the recording medium P in the feeding direction X by rotating the winding roller 6.

Four subordinate rollers 7 are rotatably arranged between the base winding roller 5 and the platen 3 to guide the recording medium P sent from the base winding roller 5. The first, second and fourth subordinate rollers 7 arranged toward the downstream side of the base winding roller 5 in the feeding direction X horizontally support the recording medium P at the almost same height as the platen 3, and the third subordinate roller 7 guides the recording medium P downward and gives a predetermined degree of tension to the recording medium P.

Further, other four subordinate rollers 7 are rotatably arranged between the platen 3 and the winding roller 6 to guide the recording medium P in the same manner. The first, third and fourth subordinate rollers 7 arranged toward the downstream side of the platen 3 in the feeding direction X horizontally support the recording medium P at the almost same height as the platen 3, and the second subordinate roller 7 guides the recording medium P downward and gives a predetermined degree of tension to the recording medium P.

Next, the ink used in this embodiment will be described.

Ink conforming to conditions described in "Curing System Using Optical Acid Radical-Base Generating Agent (first section)" or "Light-Induced Alternate Copolymer (second section)" of "Photo-Curing System (fourth chapter)" of "Photo-Curing Technique—Selection and Mixing Condition of Resin and Initiator Agent and Measurement and Estimation of Curing—(Information of Technical Association)" or the like can be particularly applied as the ink used in this embodiment, and ink to be cured by the normal radical polymerization may be used.

In detail, the ink used in this embodiment is photo-curable ink having a property cured by the irradiation with ultraviolet rays representing light and includes at least a polymerizing compound (including the known polymerizing compound), a photochemical initiator and a color material as main components. However, when the ink conforming to conditions described in "Light-Induced Alternate Copolymer (second section)" is used as the ink used in this embodiment, the photochemical initiator may be omitted.

The photo-curable ink is classified into a radical polymerization type ink including a radical polymerizing compound and cationic polymerization type ink including a cationic polymerizing compound. Both types ink can be applied as the ink used in this embodiment, and a hybrid type ink obtained by the combination of the radical polymerization type ink and the cationic polymerization type ink may be applied as the ink used in this embodiment.

However, because the cationic polymerization type ink hardly or not damaged by the polymerization based on oxygen is excellent functionally and widely in use, the cationic polymerization type ink is used in this embodiment.

The cationic polymerization type ink used in this embodiment is the mixture including at least a cationic polymerizing compound such as an oxetane compound, an epoxy compound, a vinyl ether compound or the like, a photochemical cationic initiator and a color material, and the type of ink has a property of the curing by the irradiation with the ultraviolet rays.

Next, the recording medium P used in this embodiment will be described.

As the recording medium P used in this embodiment, various types papers applied to the normal ink jet printer such as a plain paper, a recycled paper, a glossy paper and the like, and record media made of materials such as various types clothes, various types non-woven fabrics, resin, metal, glass and the like can be applied. Further the record media formed in a roll shape, a cut sheet shape, a plate shape and the like can be applied to the recording medium P. In this embodiment, a lengthened made-of-resin film rolled in a roll shape is used as the recording medium P.

Particularly, a made-of-resin film having the transparent or opaque and non-absorptive property and used for so-called flexible packaging can be applied as the recording medium P used in this embodiment. As types of resin used for the made-of-resin film, polyethylene-terephthalate, polyester, polyolefin, polyamide, polyesteramide, polyether, polyimide, polyamideimide, polystyrene, polycarbonate, poly-ρ-phenylenesulfide, polyetherester, polyvinyl chloride, poly (meta)acrylicester, polyethylene, polypropylene, nylon and the like can be applied. Further, co-polymer of those resins, mixture of those resins, bridge formation of those resins and the like can be applied as the resin used for the made-of-resin film. Among of those resins, when transparency, size stability, rigidity, environmental burden, cost and the like in the made-of-resin film are considered, any of the extended polyethyleneterephthalate, polystyrene, polypropylene and nylon is preferred as the type of resin used for the made-of-resin film. Further the made-of-resin film having the thickness of 2 micro-meters (μm) or more and 100 μm or less (preferably, 6 μm or more and 50 μm or less) is preferred. Further surface treatment such as corona jet treatment, adhesion-adding treatment or the like may be performed for the surface of a supporting member of the made-of-resin film.

Moreover, known opaque record media such as various papers of which the surfaces are coated with resin, a film including pigment, a foam film and the like can be applied as the recording medium P used in this embodiment.

Next, the operation of the ink jet printer according to this embodiment will be described with reference to FIGS. 1, 2 and 3.

In this embodiment, the recording medium P is held on the platen 3 and is fed from the upstream side to the downstream side in the feeding direction X by the base winding roller 5, the winding roller 6 and the subordinate winding rollers 7. During the feeding, the recording heads 8 jet the ink one after another according to predetermined image information in the order from the recording head 8 of black (Bk) placed on the most upstream side in the feeding direction X of the recording medium P to the recording head 8 of yellow (Y) placed on the downstream side in the feeding direction X, and an image is recorded on the recording medium P. In detail, when the ink jetted from the recording head 8 of black (Bk) arrives at the recording medium P, the ultraviolet ray sources 11 of the ultraviolet ray irradiating device 10 adjacent to the recording head 8 of black (Bk) and arranged on the downstream side of the recording head 8 emit the ultraviolet rays to the black colored ink and cure the surface of the ink. Thereafter, when the ink jetted from the recording head 8 of cyan (C) arrives at the recording medium P, the ultraviolet ray sources 11 of the ultraviolet ray irradiating device 10 adjacent to the recording head 8 of cyan (C) and arranged on the downstream side of the recording head 8 emit the ultraviolet rays to the cyan colored ink and cure the surface of the ink. At this time, the surface of the black colored ink is simultaneously irradiated with the ultraviolet rays. In the same manner, the ink is jetted from each of the recording heads 8 of magenta (M) and yellow (Y), the ultraviolet ray irradiating device 10 adjacent to the recording head 8 irradiates the ink arriving at the recording medium P. At this time, the ultraviolet ray irradiating device 10 again irradiates the black colored ink and the cyan colored ink, which have already arrived at the recording medium P and have been already irradiated with the ultraviolet rays, with the ultraviolet rays. Further, the ultraviolet ray irradiating device 10 adjacent to the recording head 8 of yellow (Y) and arranged on the most downstream side in the feeding direction X of the recording medium P irradiates the types of ink with a quantity of ultraviolet rays sufficient to almost perfectly cure the types of ink. Therefore, the curing and fixing of the all amount of ink arriving at the recording medium P is completed.

As described above, each of the ultraviolet ray irradiating devices 10 adjacent to the recording heads 8 of black (Bk), cyan (C) and magenta (M) respectively is provided with the ultraviolet ray sources 11 emitting the quantity of ultraviolet rays set to cure only the surface of the ultraviolet ray curable ink. Accordingly, the change in the image quality caused by the enlarging of the diameter of dots of the ink, the blurring of the recording medium with the ink and the like can be sufficiently prevented. Further, only the ultraviolet ray irradiating device 10 arranged on the most downstream side in the feeding direction X of the recording medium P is provided with the ultraviolet ray sources 11 emitting the quantity of ultraviolet rays set to almost perfectly cure the inside of the ink. Accordingly, the ink arriving at the recording medium P can be sufficiently cured and fixed to the recording medium P.

Further, as described above, in this embodiment, because it is sufficient that each of the ultraviolet ray irradiating devices 10 adjacent to the recording heads 8 of black (Bk), cyan (C) and magenta (M) respectively irradiates the ink with a quantity of ultraviolet rays capable to prevent the blurring of the recording medium with the ink, that is, to cure only the surface of the ink, the ultraviolet ray irradiating devices 10 can be miniaturized. Accordingly, because the intervals of the recording heads can be narrowed, the irradiation timing of the ultraviolet rays is not delayed, the enlarging of the diameter of dots of the ink, the blurring of the recording medium with the ink and the like can be prevented, and the image quality can be improved.

Moreover, only the ultraviolet ray irradiating device 10 arranged on the most downstream side in the feeding direction X of the recording medium P emits the quantity of ultraviolet rays required to almost perfectly cure the inside of the ink besides. Accordingly, the image of the high quality can be formed without the blurring of the recording medium with the ink, and the quantity of the ultraviolet rays emitted from the ultraviolet ray irradiating devices 10 except the ultraviolet ray irradiating device 10, which is arranged on the most downstream side in the feeding direction X of the recording medium P, can be reduced. As a result, the ultraviolet ray irradiating devices 10 and the image recording section 2 having those can be miniaturized, and the consumed electric power can be reduced.

In this embodiment, a quantity of the ultraviolet rays emitted from the ultraviolet ray irradiating device 10, which is arranged on the most downstream side in the feeding direction X of the recording medium P, is set to be larger than that of the ultraviolet rays emitted from each of the other ultraviolet ray irradiating devices 10, and the ink is reliably and almost perfectly cured by the ultraviolet ray irradiating device 10 arranged on the most downstream side. However, the ink may be reliably and almost perfectly cured by the ultraviolet ray irradiating device 10 arranged on the most downstream side in the feeding direction X of the recording medium P by setting the intensity of the ultraviolet rays emitted from the ultraviolet ray irradiating device 10, which is arranged on the most downstream side, to be larger than that of the ultraviolet rays emitted from each of the other ultraviolet ray irradiating devices 10.

Further, the wavelength of the ultraviolet rays emitted from the ultraviolet ray source 11 changes in dependent on the type of the ultraviolet ray source 11. The ink has the following property. When the ink is irradiated with the ultraviolet rays of a shorter wavelength, only the surface of the ink is cured. When the ink is irradiated with the ultraviolet rays of a longer wavelength, the ultraviolet rays reach the inside of the ink, and the ink can be almost perfectly cured. Therefore, as an example, a plurality of metal halide lamps or LEDs, which emit the ultraviolet rays including many longer wavelength components, may be used as the ultraviolet ray sources 11 of the ultraviolet ray irradiating device 10 arranged on the most downstream side in the feeding direction X of the recording medium P, and a plurality of high pressure mercury lamps or low pressure mercury lamps may be used as the ultraviolet ray sources 11 of the other ultraviolet ray irradiating devices 10. In this structure of the ultraviolet ray irradiating devices 10, the surface of the ink jetted from each recording head 8 can be cured by the ultraviolet ray irradiating device 10 arranged on the downstream side of the recording head 8 to prevent the blurring of the recording medium P with the ink, and the ink can be reliably and almost perfectly cured by the ultraviolet ray irradiating device 10 arranged on the most downstream side.

Moreover, in this embodiment, each ultraviolet ray irradiating device 10 is arranged between two recording heads 8. However, the embodiment is not limited to this arrangement of the ultraviolet ray irradiating devices 10. For example, two ultraviolet ray irradiating devices 10 may be respectively arranged on both the downstream side of the recording head 8 arranged on the most upstream side in the feeding direction X of the recording medium P and the downstream side of the recording head 8 arranged on the most downstream side in the feeding direction X of the recording medium P. In this case, a quantity of the ultraviolet rays emitted from the ultraviolet ray irradiating device 10, which is arranged on the downstream side of the recording head 8 arranged on the most downstream side in the feeding direction X of the recording medium P, is set to be larger than that of the ultraviolet rays emitted from the other ultraviolet ray irradiating device 10 to be able to reliably and almost perfectly cure the ink.

The entire disclosure of Japanese Patent Application No. Tokugan 2002-360920 filed on Dec. 12, 2002 including specification, claims, drawings and summary are incorporated herein by reference in its entirety.

What is claimed is:

1. An ink jet printer comprising:

a plurality of pairs each of which comprises:

a line print type recording head for jetting ink, which is to be cured by being irradiated with an ultraviolet ray, to the recording medium, and an ultraviolet ray irradiating device arranged on a downstream side of the recording head, the irradiating device having an ultraviolet ray source for irradiating the ink jetted by the recording head with an ultraviolet ray, after arriving of the ink at the recording medium, to cure the ink, wherein a quantity of the ultraviolet ray emitted from the ultraviolet ray source arranged on the most downstream side in the feeding direction of the recording medium, in the plurality of pairs, is set to be larger than that of the ultraviolet rays emitted from the ultraviolet ray source or the ultraviolet ray sources of the other ultraviolet ray irradiating device or each of the other ultraviolet ray irradiating devices.

2. The ink jet printer of claim 1; wherein the number of ultraviolet ray sources of the ultraviolet ray irradiating device arranged on the most downstream side in the feeding direction of the recording medium is larger than that of the other ultraviolet ray irradiating device or each of the other ultraviolet ray irradiating devices.

3. The ink jet printer of claim 1; wherein the ultraviolet rays emitted from the ultraviolet ray source or the ultraviolet ray sources of the ultraviolet ray irradiating device, which is arranged on the most downstream side in the feeding direction of the recording medium, has a longer wavelength or more longer wavelength components than a wavelength or longer wavelength components of the ultraviolet rays emitted from the ultraviolet ray source or the ultraviolet ray sources of the other ultraviolet ray irradiating device or each of the other ultraviolet ray irradiating devices.

4. The ink jet printer of claim 1; wherein each ultraviolet ray irradiating device is arranged on the downstream side of the corresponding recording head in the feeding direction of the recording medium.

5. The ink jet printer of claim 1; wherein each of the ultraviolet ray sources is one of a high pressure mercury lamp, a low pressure mercury lamp, a metal halide lamp, a cold cathode tube, a semiconductor laser and a light emitting diode.

6. The ink jet printer of claim 1; wherein each of the ultraviolet ray sources is obtained by combining two of a high pressure mercury lamp, a low pressure mercury lamp, a metal halide lamp, a cold cathode tube, a semiconductor laser and a light emitting diode.

7. The ink jet printer of claim 1; wherein the ink is a cationic polymerization type ink.

8. An ink jet printer comprising:

a plurality of pairs each of which comprises:

a line print type recording head for jetting ink, which is to be cured by being irradiated with an ultraviolet ray, to the recording medium, and an ultraviolet ray irradiating device arranged on a downstream side of the recording head, the irradiating device having an ultraviolet ray source for irradiating the ink jetted by the recording head with an ultraviolet ray, after arriving of the ink at the recording medium, to cure the ink, wherein intensity of the ultraviolet ray emitted from the ultraviolet ray source arranged on the most downstream side in the feeding direction of the recording medium, in the plurality of pairs, is set to be larger than that of the ultraviolet rays emitted from the ultraviolet ray source or the ultraviolet ray sources of the other ultraviolet ray irradiating device or each of the other ultraviolet ray irradiating devices.

9. The ink jet printer of claim 8; wherein the number of ultraviolet ray sources of the ultraviolet ray irradiating device arranged on the most downstream side in the feeding direction of the recording medium is larger than that of the other ultraviolet ray irradiating device or each of the other ultraviolet ray irradiating devices.

10. The ink jet printer of claim 8; wherein the ultraviolet rays emitted from the ultraviolet ray source or the ultraviolet ray sources of the ultraviolet ray irradiating device, which is arranged on the most downstream side in the feeding direction of the recording medium, has a longer wavelength or more longer wavelength components than a wavelength or longer wavelength components of the ultraviolet rays emitted from the ultraviolet ray source or the ultraviolet ray sources of the other ultraviolet ray irradiating device or each of the other ultraviolet ray irradiating devices.

11. The ink jet printer of claim 8; wherein each ultraviolet ray irradiating device is arranged on the downstream side of the corresponding recording head in the feeding direction of the recording medium.

12. The ink jet printer of claim 8; wherein each of the ultraviolet ray sources is one of a high pressure mercury lamp, a low pressure mercury lamp, a metal halide lamp, a cold cathode tube, a semiconductor laser and a light emitting diode.

13. The ink jet printer of claim 8; wherein each of the ultraviolet ray sources is obtained by combining two of a high pressure mercury lamp, a low pressure mercury lamp, a metal halide lamp, a cold cathode tube, a semiconductor laser and a light emitting diode.

14. The ink jet printer of claim 8; wherein the ink is a cationic polymerization type ink.

15. An ink jet printer comprising:

a plurality of pairs each of which comprises:

a line print type recording head for jetting ink, which is to be cured by being irradiated with an ultraviolet ray, to the recording medium, and an ultraviolet ray irradiating device arranged on a downstream side of the recording head, the irradiating device having an ultraviolet ray source for irradiating the ink jetted by the recording head with an ultraviolet ray, after arriving of the ink at the recording medium, to cure the ink, wherein the ultraviolet rays emitted from the ultraviolet ray source or the ultraviolet ray sources of the ultraviolet ray irradiating device, which is arranged on the most downstream side in the feeding direction of the recording medium, in the plurality of pairs, has a longer wavelength or more longer wavelength components tan a wavelength or longer wavelength components of the ultraviolet rays emitted from the ultraviolet ray source or the ultraviolet ray sources of the other ultraviolet ray irradiating device or each of the other ultraviolet ray irradiating devices.

16. The ink jet printer of claim 15; wherein the number of ultraviolet ray sources of the ultraviolet ray irradiating device arranged on the most downstream side in the feeding direction of the recording medium is larger than that of the other ultraviolet ray irradiating device or each of the other ultraviolet ray irradiating devices.

17. The ink jet printer of claim 15; wherein each ultraviolet ray irradiating device is arranged on the downstream side of the corresponding recording head in the feeding direction of the recording medium.

18. The ink jet printer of claim 15; wherein each of the ultraviolet ray sources is one of a high pressure mercury lamp, a low pressure mercury lamp, a metal halide lamp, a cold cathode tube, a semiconductor laser and a light emitting diode.

19. The ink jet printer of claim 15; wherein each of the ultraviolet ray sources is obtained by combining two of a high pressure mercury lamp, a low pressure mercury lamp, a metal halide lamp, a cold cathode tube, a semiconductor laser and a light emitting diode.

20. The ink jet printer of claim 15; wherein the ink is a cationic polymerization type ink.

* * * * *